US010851330B2

(12) United States Patent
Laser et al.

(10) Patent No.: US 10,851,330 B2
(45) Date of Patent: Dec. 1, 2020

(54) METHOD OF IMPROVING PAPER MACHINE FABRIC PERFORMANCE

(71) Applicant: Dubois Chemicals, Inc., Kemper Road, OH (US)

(72) Inventors: Harold Laser, Hamilton (CA); Brandon E. Mahler, Cincinnati, OH (US)

(73) Assignee: DuBois Chemicals, Inc., Sharonville, OH (US)

( * ) Notice: Subject to any disclaimer, the term of this patent is extended or adjusted under 35 U.S.C. 154(b) by 129 days.

(21) Appl. No.: 15/220,931

(22) Filed: Jul. 27, 2016

(65) Prior Publication Data

US 2017/0029748 A1 Feb. 2, 2017

Related U.S. Application Data

(60) Provisional application No. 62/198,517, filed on Jul. 29, 2015.

(51) Int. Cl.
*C11D 11/00* (2006.01)
*D21F 7/08* (2006.01)
(Continued)

(52) U.S. Cl.
CPC ..... *C11D 11/0017* (2013.01); *B08B 3/022* (2013.01); *B08B 3/026* (2013.01); *C11D 3/044* (2013.01); *C11D 3/2086* (2013.01); *C11D 3/37* (2013.01); *C11D 3/3757* (2013.01); *D06B 5/08* (2013.01); *D21F 1/32* (2013.01);
(Continued)

(58) Field of Classification Search
CPC ..... C11D 11/00; C11D 17/00; D21F 1/32
See application file for complete search history.

(56) References Cited

U.S. PATENT DOCUMENTS 4,571,303 A 2/1986 Ciallella
4,711,730 A 12/1987 Gosselink et al.
(Continued)

FOREIGN PATENT DOCUMENTS

CA 2228774 A1 8/1998
CA 2916074 A1 6/2016
(Continued)

OTHER PUBLICATIONS

Google translation in English Language of CN104631187A cited in IDS, pct search report. 2015. pp. 1-4.*
(Continued)

*Primary Examiner* — Vasudevan S Jagannathan
*Assistant Examiner* — Preeti Kumar
(74) *Attorney, Agent, or Firm* — Dinsmore & Shohl LLP

(57) ABSTRACT

Methods are provided for improving the papermaking process. In various embodiments, the methods include the application of alkali material in combination with an anionic polymeric dispersant and/or a hydroxyfunctional carboxylic acid to papermaking fabrics such that the application thereof removes contaminants from the papermaking fabrics and improves the drainage of said papermaking fabrics. Such alkali material in combination with an anionic polymeric dispersant and/or a hydroxyfunctional carboxylic acid can be applied as a single aqueous solution, and may further comprise a surfactant.

25 Claims, 5 Drawing Sheets

(51) Int. Cl.

| | |
|---|---|
| ***D21F 7/12*** | (2006.01) |
| ***C11D 3/37*** | (2006.01) |
| ***C11D 3/20*** | (2006.01) |
| ***C11D 3/04*** | (2006.01) |
| ***D21F 1/32*** | (2006.01) |
| ***B08B 3/02*** | (2006.01) |
| ***D06B 5/08*** | (2006.01) |

(52) U.S. Cl.
CPC ..... *D21F 7/08* (2013.01); *D21F 7/12* (2013.01); *D06B 2700/14* (2013.01)

(56) References Cited

U.S. PATENT DOCUMENTS

| | | | | | |
|---|---|---|---|---|---|
| 4,715,931 | A * | 12/1987 | Schellhamer | D21F 1/32 | 162/199 |
| 4,785,060 | A | 11/1988 | Nagler | | |
| 4,883,610 | A | 11/1989 | Ciallella | | |
| 4,886,575 | A | 12/1989 | Moreland | | |
| 4,892,622 | A * | 1/1990 | Malkki | D21F 1/009 | 162/207 |
| 5,080,759 | A | 1/1992 | Buzby et al. | | |
| 5,135,613 | A | 8/1992 | Waldmann | | |
| 5,139,616 | A | 8/1992 | Ling | | |
| 5,223,097 | A | 6/1993 | Hassler | | |
| 5,300,194 | A | 4/1994 | Welkener et al. | | |
| 5,368,694 | A | 11/1994 | Rohlf et al. | | |
| 5,415,739 | A | 5/1995 | Furman, Jr. et al. | | |
| 5,490,903 | A * | 2/1996 | Chen | A61K 8/0208 | 162/111 |
| 5,651,812 | A * | 7/1997 | McDermott | D06M 13/192 | 106/2 |
| 5,863,385 | A | 1/1999 | Siebott et al. | | |
| 5,916,857 | A | 6/1999 | Watson et al. | | |
| 6,051,108 | A | 4/2000 | O'Neal, Jr. | | |
| 6,060,439 | A | 5/2000 | Doyel et al. | | |
| 6,153,723 | A | 11/2000 | Lang et al. | | |
| 6,172,031 | B1 | 1/2001 | Stevens | | |
| 6,369,010 | B1 | 4/2002 | Dreisbach et al. | | |
| 6,402,891 | B1 | 6/2002 | Asher et al. | | |
| 6,451,756 | B2 | 9/2002 | Shulman et al. | | |
| 6,723,207 | B2 | 4/2004 | Laser | | |
| 6,890,405 | B1 | 5/2005 | Mah | | |
| 7,101,832 | B2 | 9/2006 | Asher et al. | | |
| 7,850,824 | B2 | 12/2010 | Baker et al. | | |
| 8,440,598 | B2 | 5/2013 | Sehgal et al. | | |
| 9,512,387 | B2 | 12/2016 | Laser et al. | | |
| 2001/0036912 | A1 | 11/2001 | Shulman et al. | | |
| 2002/0171725 | A1* | 11/2002 | Ouchi | C09D 11/322 | 347/100 |
| 2003/0064910 | A1 | 4/2003 | Fong et al. | | |
| 2003/0148911 | A1 | 8/2003 | Smith et al. | | |
| 2004/0020617 | A1 | 2/2004 | Laser | | |
| 2006/0272789 | A1 | 12/2006 | Szep et al. | | |
| 2008/0087393 | A1 | 4/2008 | Pease et al. | | |
| 2009/0090057 | A1 | 4/2009 | Regnery et al. | | |
| 2009/0281012 | A1 | 11/2009 | Trivedi et al. | | |
| 2009/0285871 | A1* | 11/2009 | Cunningham | A01N 37/16 | 424/405 |
| 2011/0119841 | A1 | 5/2011 | Bennett et al. | | |
| 2012/0043040 | A1* | 2/2012 | Zhang | D21C 9/08 | 162/199 |
| 2012/0204916 | A1 | 8/2012 | Laser et al. | | |
| 2012/0264669 | A1 | 10/2012 | Cristobal et al. | | |
| 2015/0148279 | A1 | 5/2015 | Laser et al. | | |
| 2016/0081890 | A1 | 3/2016 | Stevenson | | |
| 2016/0177505 | A1 | 6/2016 | Laser et al. | | |
| 2017/0009184 | A1 | 1/2017 | Schubert et al. | | |

FOREIGN PATENT DOCUMENTS

| | | | | |
|---|---|---|---|---|
| CN | 104631187 | A | 5/2015 | |
| EP | 178340 | A1 | 11/1990 | |
| EP | 648820 | A2 | 4/1995 | |
| EP | 773284 | A1 | 5/1997 | |
| EP | 647737 | A1 | 5/1999 | |
| EP | 1493803 | B1 | 6/2006 | |
| EP | 1956075 | A1 | 8/2008 | |
| EP | 2921541 | A1 | 9/2015 | |
| JP | 2003313251 | * | 6/2003 | |
| JP | 2004019014 | A * | 1/2004 | |
| WO | 2008045096 | A1 | 4/2008 | |
| WO | 2009137096 | A1 | 11/2009 | |
| WO | WO 2014132175 | A1 * | 9/2014 | D21H 17/07 |

OTHER PUBLICATIONS

Google translation in English Language of JP2003313251. 2003 pp. 1-36.*

Keiji et al. JP2004019014A Google Patents Translation in English. pp. 1-6. Jan. 2004. (Year: 2004).*

U.S. Appl. No. 14/972,235 Office Action dated Apr. 5, 2017 by U.S. Patent and Trademark Office.

ALFONIC® Alcohol Ethoxylates from High Range Alcohols C12-C18; Technical Data Sheet; Sasol North America Inc.; Jan. 2003; pp. 1-3.

Rhodiasolv® IRIS; Rhodia; http://www.rhodia.com/en/binaries/novecare_rhodiasolv_iris_flyer_EN; Mar. 2008.

Hansen, C.; What are HSP?; www/hansen-solubility.com/index.php?; May 29, 2007; pp. 1-3.

BIO-TERGE® PAS-8S; Products page; Stepan Company; p. 1; 2011.

BIO-SOFT® S-101; Products page; Stepan Company; p. 1; 2011.

Isophorone Product Information; The Dow Chemical Company; Jun. 2002; pp. 1-2.

Proglyde DMM Product Information; The Dow Chemical Company; Mar. 2004; pp. 1-2.

DOWANOL DPnB Product Information; The Dow Chemical Company; Mar. 2004; pp. 1-3.

DOWANOL TPnB Product Information; The Dow Chemical Company; Mar. 2004; pp. 1-2.

Tomadol® 25-12 Ethoxylated Alcohol; Product Information; Air Products and Chemicals, Inc. 1996-2011; p. 1.

Stach, S.; Using Hansen Space to Optimize Solvent Based Cleaning Processes for Manufacturing Electronic Assemblies; The Science of Cleaning; Jun. 18, 2009; pp. 1-9; Austin American Technology; Burnet, Texas.

Examiner's Report dated Nov. 1, 2013, relating to corresponding Canadian Patent Application No. 2,764,794.

Search Report and Written Opinion pertaining to Application No. PCT/US2016/044797 dated Oct. 31, 2016.

International Preliminary Report of Patentability filed in International Application No. PCT/US2016/044797 dated Jan. 30, 2018.

* cited by examiner

METHOD OF IMPROVING PAPER MACHINE FABRIC PERFORMANCE

CROSS REFERENCE TO RELATED APPLICATION

This application claims benefit to U.S. Provisional Patent Application Ser. No. 62/198,517 filed Jul. 29, 2015, which is incorporated by reference in its entirety.

TECHNICAL FIELD

Embodiments described herein relate generally to the application of alkali material in combination with an anionic polymeric dispersant and/or a hydroxyfunctional carboxylic acid to papermaking fabrics such that the application thereof removes contaminants from the papermaking fabrics and improves the drainage of said papermaking fabrics. Such alkali material in combination with an anionic polymeric dispersant and/or a hydroxyfunctional carboxylic acid can be applied as a single aqueous solution, and may further comprise a surfactant.

BACKGROUND

Generally, the paper manufacturing process employs a machine that systematically de-waters a pulp slurry. The pulp slurry consists largely of cellulose wood fibers, along with various chemical additives used as fillers and functional components of the paper or paper products. The pulp is prepared from various species of wood, basically by either of two pulping methods: chemical digestion to separate the cellulose fibers from lignin and other natural organic binders, or by mechanical grinding and refining. The resulting cellulose fibers are used in the manufacture of paper products, whereby the pulp is supplied to a paper machine system, slurried in water to various solids levels (termed "consistency"), and ultimately diluted to about 0.5-1.0% solids for subsequent de-watering to form a sheet of paper. This low consistency of solids of the pulp is necessary in order to facilitate fast drainage on the former, while also achieving proper fiber-to-fiber contact and orientation in the sheet. De-watering begins on the former, which is a synthetic wire or mesh that permits drainage to form a wet-web.

The wet-web is then transferred into the machine press section and is squeezed between roller nips and synthetic press felts (predominantly comprised of nylon) to further remove water. The web is further transferred through a dryer section comprised of steam-heated roller cans. Finally, the sheet is wound onto a reel. Other process stages can include on-machine surface sizing, coating, and/or calendaring to impart functional paper characteristics.

Generally, the wet-web is approximately 20% solids coming off of the former, 40% solids after leaving the press section, and about 94-97% solids (3-6% moisture) as the paper on the reel. Various chemical compounds are added to the fiber slurry to impart certain functional properties to different types of paper. Fillers such as clay, talc, titanium dioxide, and calcium carbonate may be added to the slurry to impart opacity, improve brightness, improve sheet printing, substitute for more expensive fiber, improve sheet smoothness, and improve overall paper quality. Additionally, various organic compounds are added to the fiber slurry to further enhance paper characteristics. These organic compounds include, but are not limited to: sizing agents (either acid rosin, alkaline AKD, alkaline ASA) to improve sheet printing so that the ink doesn't bleed through the sheet; starch for internal fiber bonding strength, retention aids to help hold or bind the inorganic fillers and cellulose fines in the sheet; brightening compounds; dyes; as well as various other organic compounds. Therefore, as the sheet is de-watered on the paper machine, many types of deposits can result on the papermaking equipment. These deposits can result from the chemicals used in the process, natural wood compounds that are not thoroughly removed from pulping processes, or from inclusion of recycled fiber in the pulp slurry as a result of water re-use.

The primary function of the press felts, other than a means of sheet conveyance, is to aid in the de-watering process of the wet-web. The press felts absorb, receive, and transport water that is expressed from the wet-web by the pressure of the roller nips. On most modern paper machines, the water is subsequently removed from the press felts by vacuum elements in the press, the vacuum elements consisting of the Uhle boxes and suction press rolls. The press felts then return in their travel loop back to the nip, and continually receive and transport water away from the web. Consequently, the press felts become contaminated with various types of soils resulting from both the web compounds and from the process shower waters used to flush the press felts.

Various types of cleaning agents are used remove contaminants in the press felts. These cleaning agents can be broadly classified as alkaline or caustic cleaners, neutral cleaners, acidic cleaners, and solvent-type cleaners. These cleaning agents can further include additional additives. Such additives include, but are not limited to, chelants, surfactants, builders, scale preventative agents, and dispersing agents. The cleaning agents that have the broadest utility in the removal of contaminants from papermaking fabrics are alkaline cleaners. Alkaline cleaners are cleaners which have a pH range of a 1% solution ranging from about 9.5 to about 13.5.

Alkaline cleaners have broad utility because they remove a wide variety of contaminants from papermaking fabrics. Such contaminants include, but are not limited to, pitches, stickies, waxes, sizing materials, starches, wet strength resins, dry strength resins, and oils. A major contaminant that is commonly found in papermaking fabrics is called papermaking fines. Papermaking fines typically consist of very small fragments of cellulosic papermaking fibers which are not bound in the paper web, as is described above. Papermaking fines include, but not limited to those derived from wood based pulp, recycled pulp, and other cellulosic sources. These papermaking fines are mobile and can be trapped into the batt or weave of papermaking fabrics. When they do, these papermaking fines interfere with the proper flow of water through the papermaking fabric. Furthermore, these papermaking fines may be bound into the papermaking fabric by other contaminants, which are listed above.

In order to remove these papermaking fines, it is often necessary to treat the papermaking fabric with an alkaline cleaner to first remove the other contaminants which surround the paper fines. Subsequently, mechanical flushing, showering, and vacuuming is used to remove the papermaking fines. However, a significant drawback of these alkaline cleaners is that the higher operating pH at which these cleaners are most effective is also the pH at which papermaking fines tend to increase in size, due to a phenomenon commonly called "fines swelling". The fines swelling and accompanying increase in papermaking fines size and volume thus further impede the flow of water through the papermaking fabric. As such, there is a decrease in the performance of the fabric and interference with the efficient operation of the paper machine, often resulting in: speed reductions, sheet crushing, quality defects, excess energy consumption, holes and possibly machine downtime and increased costs.

All of the aforementioned issues pertaining to materials commonly referred to as papermaking fines may also apply to another common, and broader, class of contaminating materials called wet soils. Wet soils are hydrophilic contaminants in the papermaking fabric that naturally hold water. Wet soils include the previously described papermaking fines and papermaking fibers, including but not limited to those derived from wood based pulp, recycled pulp, and other cellulosic sources. Wet soils also include: hydrosols and hydrogels. Hydrogels are water containing polymeric materials or matrixes including but not limited to: wet and dry strength resins, including but not limited to polyamideamine-epicholorhydrin and glyoxalated polyacrylamide; natural and modified starches; alkylketene dimers; alkyl succinic anhydride and rosine-based sizing; carboxyl methyl cellulose; guar gum; and retention aids, including but not limited to polyamines and polydadmac. Hydrosols are colloidal materials including but not limited to silicates, carbonates and other inorganic fillers. As such, these wet soils will behave similarly to papermaking fines in the papermaking felt, in that the wet soils response to alkaline cleaners will hinder drainage through the felt. This concept is further developed in the Tissue World Americas 2014 presentation *Understanding and Controlling Press Fabric Filling.*

Accordingly, there is a need in the art for methods that will improve paper machine fabric performance, particularly the removal of contaminants from the papermaking fabrics.

SUMMARY

Embodiments of the disclosure meet those needs by providing a method of treating papermaking fabrics that removes contaminants from the papermaking fabrics and improves the drainage of the papermaking fabrics.

According to one embodiment of the disclosure, a method of treating papermaking fabrics is provided. The method comprises applying an alkali material in combination with an anionic polymeric dispersant and/or a hydroxyfunctional carboxylic acid to the papermaking fabrics. The application of the alkali material in combination with the anionic polymeric dispersant and/or the hydroxyfunctional carboxylic acid removes contaminants from the papermaking fabrics and improves the drainage of the papermaking fabrics. In a more particular embodiment, the method can further comprise applying a surfactant.

According to a further embodiment of the disclosure, the alkali material in combination with the anionic polymeric dispersant and/or the hydroxyfunctional carboxylic acid is applied as a single aqueous solution. In a more particular embodiment, the aqueous solution can further comprise a surfactant. In certain embodiments, the aqueous solution can comprise from about 1% to about 20% by weight anionic polymeric dispersant. In other embodiments, the aqueous solution can comprise from about 1% to about 20% by weight hydroxyfunctional carboxylic acid. In even further embodiments, the aqueous solution can comprise from about 1% to about 20% by weight surfactant. In even more particular embodiments, the aqueous solution can comprise from about 6% to about 18% by weight surfactant.

These and other features and advantages of the disclosure will become apparent from the following detailed description and the appended claims.

DETAILED DESCRIPTION

Figure 1A:
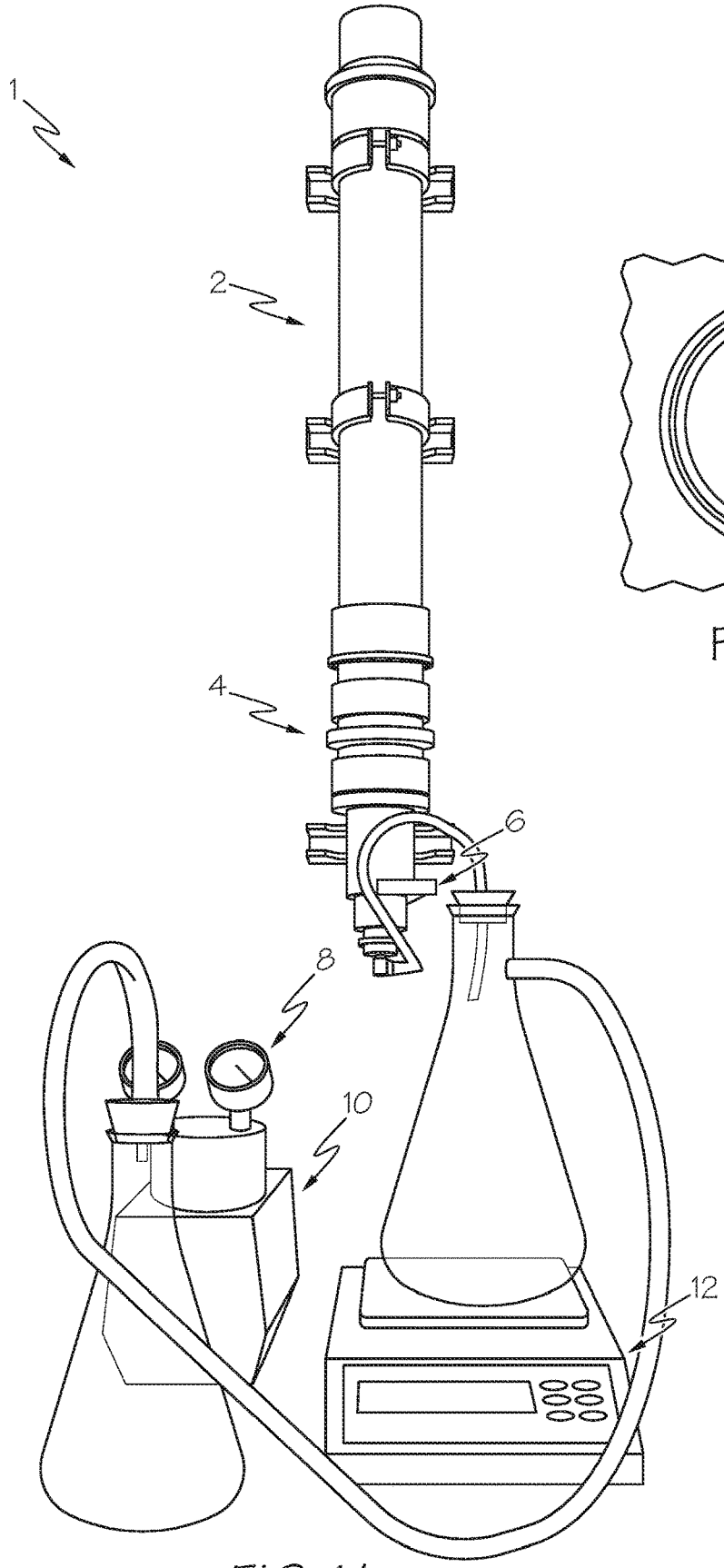
FIG. 1A is a picture of the Drainage Test Unit used to conduct the Drainage Wash Study.

Reference will now be made in detail to various embodiments of a method of treating papermaking fabrics that results in the removal of contaminants from the papermaking fabrics and improves the drainage of the papermaking fabrics. The method includes the application of an alkali material in combination with an anionic polymeric dispersant and/or a hydroxyfunctional carboxylic acid to the papermaking fabrics. Embodiments of the methods can greatly reduce or eliminate the tendency of alkaline cleaners to cause fines swelling in papermaking fabrics. Thus, embodiments of the methods can greatly increase the utility of alkaline cleaners. Embodiments of the methods allow for alkaline cleaners to be used more effectively while the paper making machine is running. Embodiments also allow for the use of alkaline cleaners at higher concentrations, and further allow for the papermaking fabrics to be flushed and rinsed more easily thus ensuring that the paper machine returns to normal operating conditions more quickly. Additionally, embodiments allow for the contaminating wet soils, including papermaking fines, to be removed more effectively resulting in better water removal properties and better drainage of water through the papermaking fabric.

Unless otherwise indicated, the disclosure of any ranges in the specification and claims are to be understood as including the ranges itself and also anything subsumed therein, as well as endpoints.

In various embodiments, a method of treating papermaking fabrics includes applying an alkali material in combination with an anionic polymeric dispersant and/or a hydroxyfunctional carboxylic acid to the papermaking fabrics. The application of the alkali material in combination with the anionic polymeric dispersant and/or the hydroxyfunctional carboxylic removes contaminants from the papermaking fabrics and improves the drainage of the papermaking fabrics. In certain embodiments, the alkali the anionic polymeric dispersant and/or hydroxyfunctional carboxylic acid are applied to the papermaking fabrics separately from the alkali material. In other embodiments, the alkali material in combination with the anionic polymeric dispersant and/or hydroxyfunctional carboxylic acid are applied as a single aqueous solution to the papermaking fabrics.

The term "papermaking fabrics" as used herein with reference to various embodiments is intended to include, but not necessarily be limited to, papermaking felts such as press felt fabrics, forming fabrics, and dryer fabrics. In some embodiments, the papermaking fabrics comprise forming fabrics, press felt fabrics, and dryer fabrics. Additionally, the term "drainage" as used herein with reference to various embodiments is intended to include the drainage rate of the papermaking fabrics. The drainage rate can be calculated, for example, by the methods detailed in Example 1.

In some embodiments, the contaminants in the papermaking fabric include organic contaminants. In some embodiments, the contaminants include wet soils. In some embodiments, the papermaking fabrics are contaminated with wet soils in an amount from about 0.1 to about 100% by weight, including any value or ranges therebetween, as determined gravimetrically. The calculation for the wet soils is as follows: wet soils=wet weight of all papermaking contaminants/(dry weight of all papermaking contaminants+papermaking fabric). As described previously, wet soils include: papermaking fines, hydrosols, hydrogels, and various combinations thereof. Papermaking fines include, but not limited to, those derived from wood based pulp, recycled pulp and other cellulosic sources. Hydrosols include, but are not limited to: wet and dry strength resins, including but not limited to polyamideamine-epichlorohydrin and glyoxalated polyacrylamide; natural and modified starches; alkylketene dimer; alkyl succinic anhydride and rosin-based sizing; carboxyl methyl cellulose; guar gum; and retention aids, including but not limited to polyamines and polydadmacs. Hydrogels include, but are not limited to silicates, carbonates, and other inorganic fillers. In some embodiments, the papermaking fabrics are contaminated with papermaking fines in an amount from about 0.1 to about 100% by weight, including any value or ranges therebetween, as determined gravimetrically.

In various embodiments, the alkali material is selected from the group consisting of sodium hydroxide, potassium hydroxide, magnesium hydroxide, ammonia, sodium carbonate, sodium silicate, sodium phosphates, potassium phosphates, alcohol amines, and combinations thereof. In some embodiments, the alkali material is selected from sodium hydroxide, potassium hydroxide, and combinations thereof. Additionally, in certain embodiments, alkali material includes materials which have a pH range of from about 9.5 to about 13.5 when in a 1% solution.

According to various embodiments, the anionic polymeric dispersant is selected from the group consisting of polyacrylic acid and sulfonated analogs and salts thereof, polymaleic acid and sulfonated analogs and salts thereof, poly (maleic anhydride) and sulfonated analogs and salts thereof, polyphosphinocarboxylic acid and sulfonated analogs and salts thereof, polyglutamic acid and sulfonated analogs and salts thereof, polyfumaric acid and sulfonated analogs and salts thereof, polylacic acid and sulfonated analogs and salts thereof, carboxylated vinyl polymers and sulfonated analogs and salts thereof, copolymers of acrylic acid and maleic acid and sulfonated analogs and salts thereof, and combinations thereof. In various embodiments, the anionic polymeric dispersant is present in the single aqueous solution in an amount from about 1% to about 20% by weight based on the solids.

In various embodiments, the hydroxyfunctional carboxylic acid is an alpha hydroxyl acid. In some embodiments, the alpha hydroxyl acid is selected form the group consisting of lactic acid, gluconic acid, glycolic acid, citric acid, mandelic acid, and salts thereof, with more particular embodiments including potassium or sodium salts thereof. In various embodiments, the hydroxyfunctional carboxylic acid is present in the single aqueous solution in an amount from about 1% to about 20% by weight based on the solids.

In some embodiments, the method may further comprise applying a surfactant to the papermaking fabrics. In some embodiments, the surfactant is selected from the group consisting of nonionic surfactants, anionic surfactants, cationic surfactants, zwitterionic surfactants, and combinations thereof. In some embodiments, the surfactant is selected from the group consisting of dodecylbenzene sulfonate, sodium-1-octane sulfonate, sodium caprylyl sulfonate, alcohol ethoxylates, and combinations thereof. In some embodiments, the single aqueous solution that is applied to the papermaking fabrics further comprises a surfactant. In various embodiments, the surfactant is present in the single aqueous solution in an amount from about 1% to about 20% by weight based on the solids. In other embodiments, the surfactant is present in the single aqueous solution comprising from about 6% to about 18% by weight based on the solids.

In some embodiments, the method may further comprise applying one or more compounds selected from the consisting of sodium hypocholorite, peroxides, triethanolamine, ethylenediaminetetraacetic acid, nitrilotriacetic acid, sodium silicate, tetrasdoium pyrophosphate, sodium tripolyphosphate, 1-(2,5-dimethoxy-4-methylphenyl)propan-2-amine, and combinations thereof. In some embodiments, the single aqueous solution can further comprise one or more compounds selected from the group consisting of sodium hypocholorite, peroxides, triethanolamine, ethylenediaminetetraacetic acid, nitrilotriacetic acid, sodium silicate, tetrasdoium pyrophosphate, sodium tripolyphosphate, 1-(2,5-dimethoxy-4-methylphenyl)propan-2-amine, and combinations thereof.

In some embodiments of the method, the single aqueous solution has a pH from about 9.5 to about 13.5. In other embodiments, the single aqueous solution has a dynamic surface tension of about 25 to about 40. In some embodiments, the aqueous solution is applied to the papermaking fabrics at a temperature from about 5° C. to about 60° C. In various embodiments, the aqueous solution is applied to the papermaking fabrics at a temperature from about 50° C. to about 55° C. In some embodiments, the aqueous solution is applied to the papermaking fabrics at a dosage of about 100 ppm to about 50,000 ppm while a papermaking machine is operating. In some embodiments, the single aqueous solution is applied to the papermaking fabrics at a dosage of about 0.1% to about 100% while a papermaking machine is not operating.

In various embodiments, the single aqueous solution is applied to the papermaking fabrics through high pressure needle showers, fan showers, flooded nip showers, manual foaming equipment, or manual spraying equipment. In more particular embodiments, the aqueous solution can be applied through such means to the papermaking fabrics either continuously or intermittently.

In order that various embodiments may be more readily understood, reference is made to the following examples which are intended to illustrate various embodiments, but not limit scope thereof.

Example 1

Figure 1B:
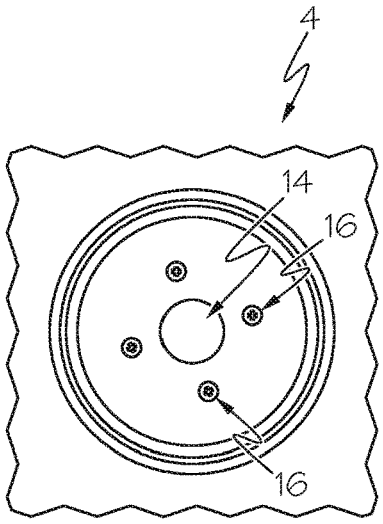
FIG. 1B is a picture of the felt mounting rig clamp of the Drainage Test Unit.

The drainage wash study method is designed to measure the ability of cleaning solutions to both remove soils and increase the water throughput of a tested felt swatch. The felts tested can be either dry or wet. Of note, if the test is run on a wet felt, only the water throughput mechanism can be measured. Felt swatches are cut into 1.5" diameter circles. If dry, these swatches are pre-weighed. Then, a swatch is fixed into the drainage column rig in the batt-base direction. The drainage column rig 1 is disclosed in FIG. 1A and FIG. 1B, and includes a solution column 2, a felt mounting rig clamp 4, an open/close ball valve 6, a vacuum control/monitor gauge 8, a vacuum pump 10, and a weight recording balance 12. The felt mounting rig clamp 4 further includes a felt swatch 14 and mounting screws 16 (FIG. 1B). The rig allows one to measure the weight of solution to pass through a specific area of the felt swatch 14 (¾" diameter) at specific time intervals (e.g. every four-tenths of a second).

The solutions can be set to run at various temperatures and/or vacuum. A number of solutions pass through the felt swatch 14 to generate the drainage rate data, and the solutions in which the drainage is measured include the initial drainage rate of the felts swatch 14 to determine its post-mortem state, the product solution drainage rate and the water rinse drainage rate. After the sequence of washes is complete, the felt swatch 14 is removed from the rig 1, is dried, and then reweighed. The results of the test are measured as the increase in drainage rate through the washing and rinsing compared to the initial swatch data and the percent soils removal based on the known amount of soils in the felt compared to the weight loss of the felt swatches. The results are based on an average of felt swatches per each test code—each series of swatches cut in the machine direction.

Example 2

Exemplary results of the Drainage Wash Study are shown below in Table 1 (using Virgin Tissue Machine) and Table 2 (using Recycle Tissue Machine).

TABLE 1

Drainage Wash Study Method of Various Additives (Virgin Tissue Machine)
Drainage Rate Measurements Only

| | product wash | | triple rinse | |
|---|---|---|---|---|
| | above caustic blend | wo/caustic blend | w/caustic blend | wo/caustic blend |
| propylene glycol | 1.690 | 0.825 | −0.324 | 2.331 |
| polycarboxylate copolymer | 15.194 | −0.754 | 9.350 | 2.226 |
| nonionic blend | −2.801 | 0.987 | −0.391 | 3.973 |
| sulfonate blend | −1.605 | −0.658 | −4.897 | 4.539 |
| polyhydroxy carboxylate | 19.006 | 0.397 | 13.612 | 4.051 |

TABLE 2

Drainage Wash Study Method of Various Additives (Recycle Tissue Machine)
Drainage Rate Measurements Only

| | product wash | | triple rinse | |
|---|---|---|---|---|
| | above caustic blend | wo/caustic blend | w/caustic blend | wo/caustic blend |
| propylene glycol | −3.305 | 0.514 | 0.417 | 2.907 |
| polycarboxylate copolymer | 12.301 | −2.412 | 2.994 | 0.537 |
| nonionic blend | 5.272 | −0.296 | 0.322 | 0.259 |
| sulfonate blend | −9.841 | −1.312 | −5.207 | −0.832 |
| polyhydroxy carboxylate | 13.279 | −0.216 | 5.962 | 1.653 |

As can be seen from Table 1 and Table 2, an anionic polymeric dispersant (polycarboxylate copolymer) and a hydroxyfunctional carboxylic acid (polyhydroxy carboxylate) result in increased drainage rates when used with a caustic blend as compared to tap water alone and all other tested additives. The tables depict the drainage rate slope change (%) using both a product wash and a triple rinse, both with a caustic blend and without a caustic blend.

Example 3

Figure 2:
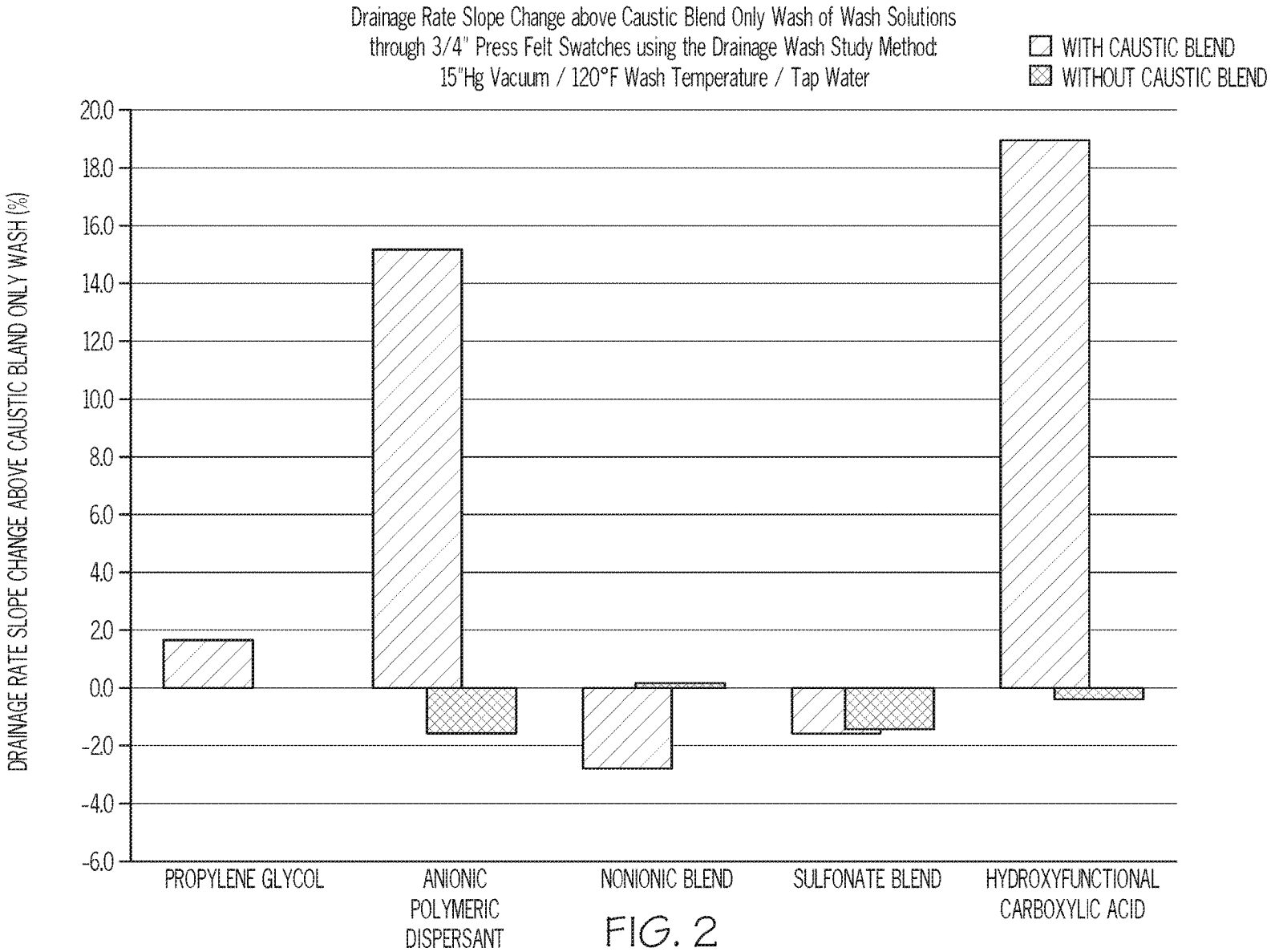
FIG. 2 is a graph demonstrating that anionic polymeric dispersants and hydroxyfunctional carboxylic acids result in increased drainage rates of wash solutions passed through ¾" press felt swatches when used with a caustic blend as compared to tap water and all other tested additives.
Figure 3:
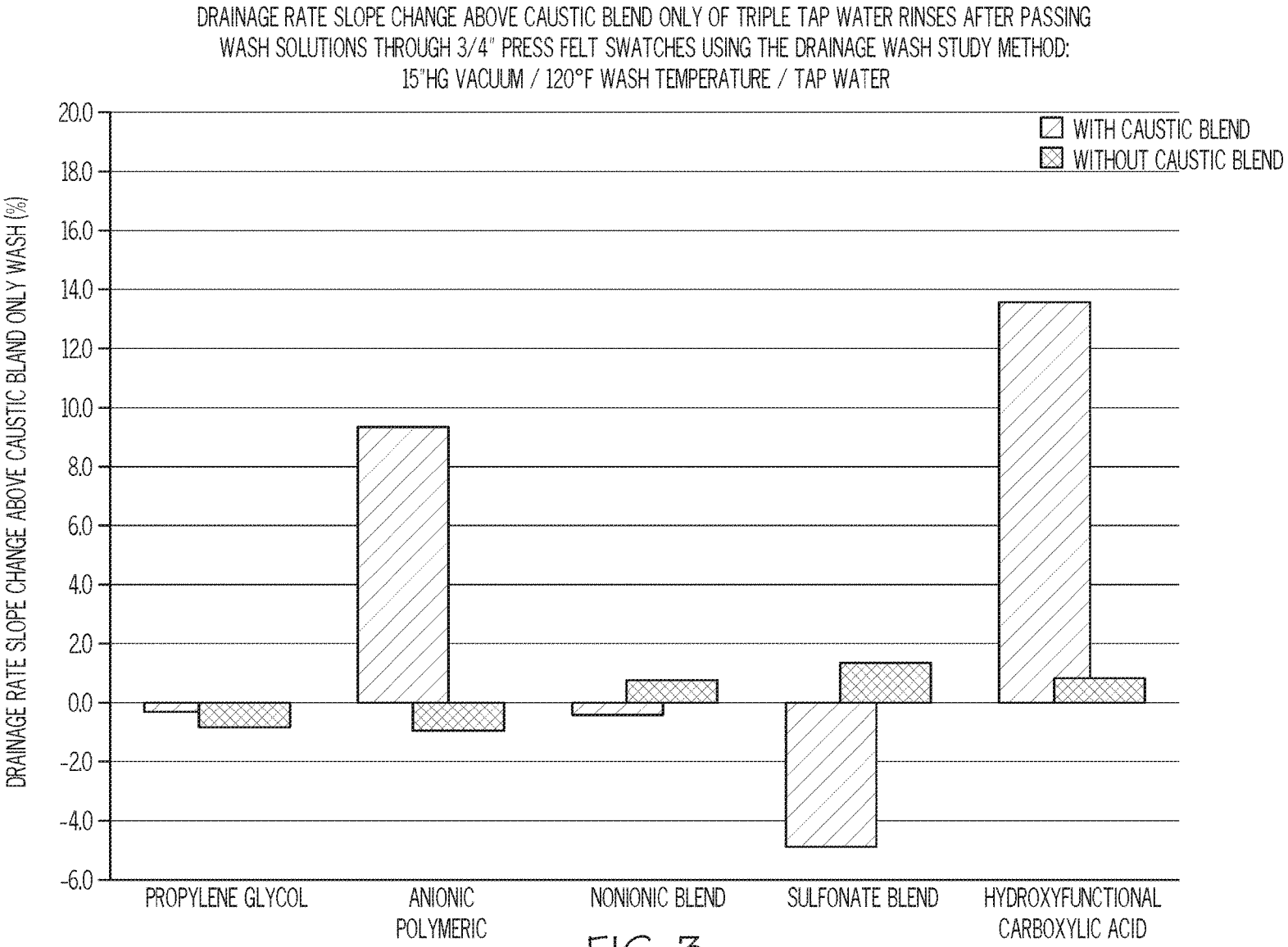
FIG. 3 is a graph demonstrating that anionic polymeric dispersants and hydroxyfunctional carboxylic acids result in increased drainage rates of triple tap water rinses after passing wash solutions through ¾" press felt swatches when used with a caustic blend as compared to tap water and all other tested additives.

Additional data from the Drainage Wash Study confirmed that anionic polymeric dispersants (maleic anhydride) and hydroxyfunctional carboxylic acids (glucoheptonate) result in increased drainage rates of when used with a caustic blend as compared to tap water and all other tested additives. As can be seen in FIG. 2 and FIG. 3, maleic anhydride and glucoheptonate resulted in increased drainage rates of solutions passed though ¾" press felt swatches using the Drainage Wash Study Method. These specific examples used a 15" Hg vacuum, a 120° F. wash temperature, and tap water. The data of FIG. 2 depicts the drainage rate slope change (%) of wash solutions passed through ¾" press felt swatches. The data of FIG. 3 depicts the drainage rate slope change (%) of triple tap water rinses after passing wash solutions through ¾" press felt swatches.

Example 4

Figure 4:
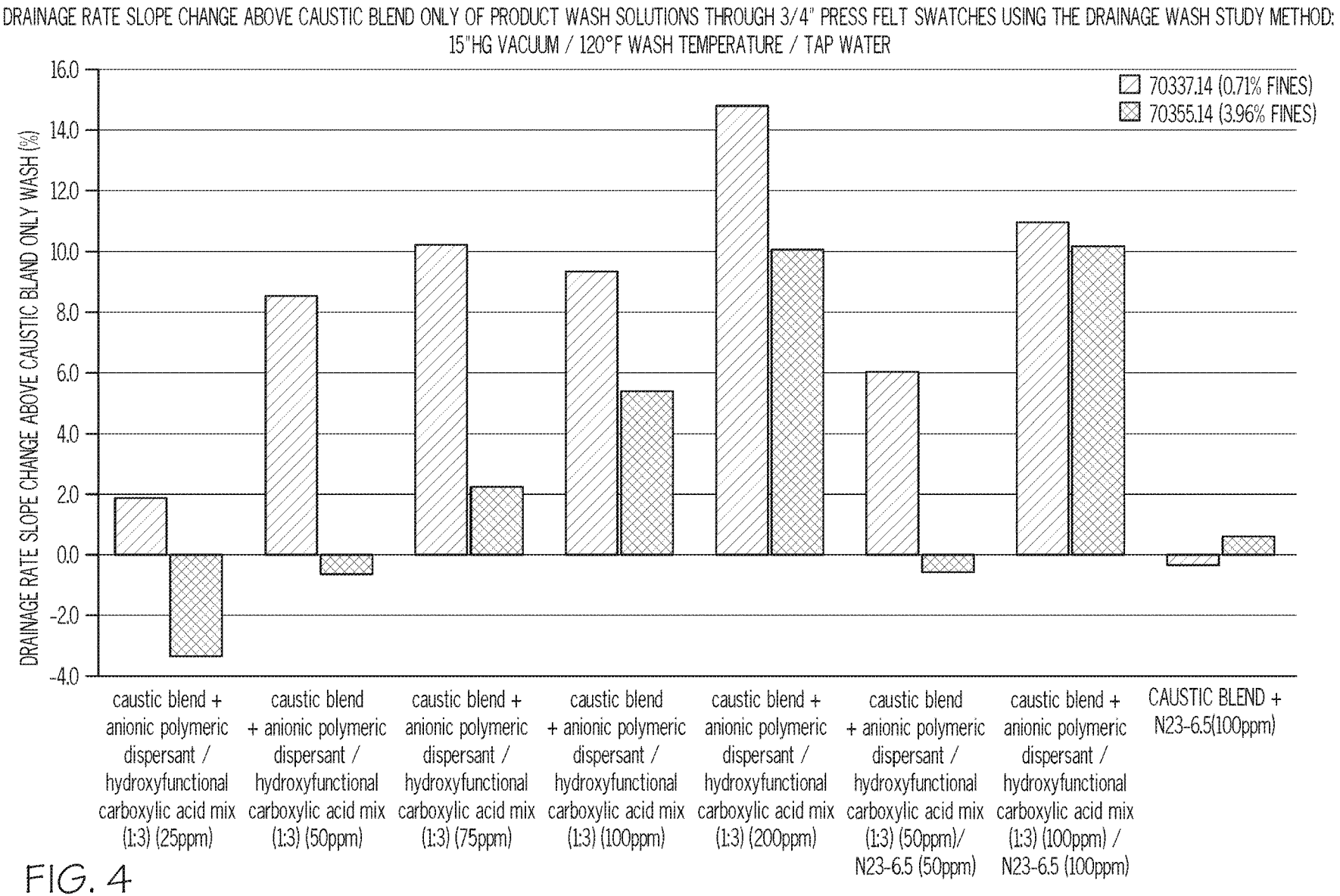
FIG. 4 is a graph demonstrating that various concentrations of a 1:3 part mixture of anionic polymeric dispersants and hydroxyfunctional carboxylic acids result in increased drainage rates of wash solutions passed through ¾" press felt swatches when used with a caustic blend on press felt swatches loaded with either a low concentration of papermaking fines or a high concentration of papermaking fines.
Figure 5:
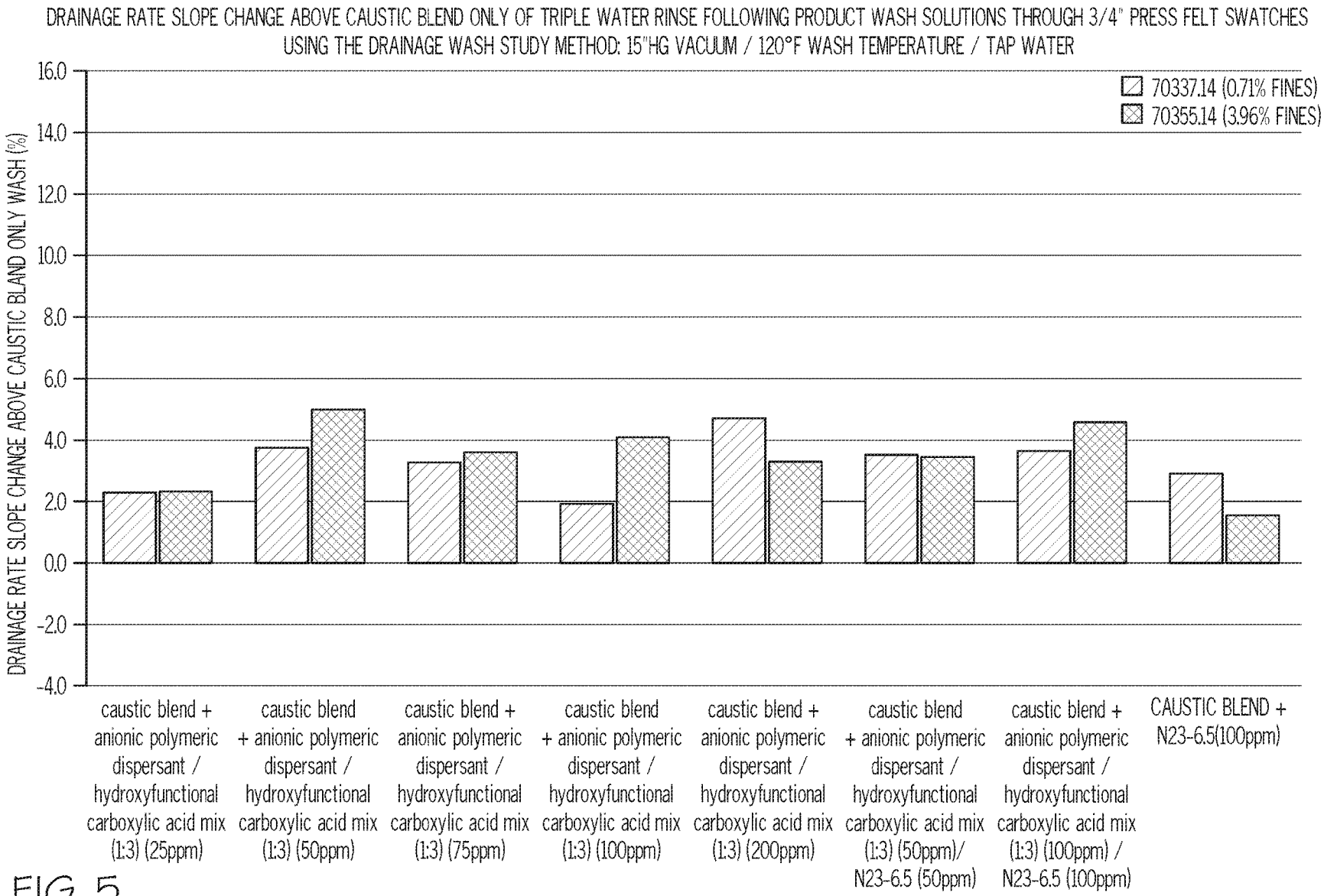
FIG. 5 is a graph demonstrating that various concentrations of a 1:3 part mixture of anionic polymeric dispersants and hydroxyfunctional carboxylic acids result in increased drainage rates of triple tap water rinses after passing wash solutions through ¾" press felt swatches when used with a caustic blend on press felt swatches loaded with either a low concentration of papermaking fines or a high concentration of papermaking fines.

Additional data from the Drainage Wash Study demonstrates that various concentrations of a 1:3 part mixture of anionic polymeric dispersants (maleic anhydride) and hydroxyfunctional carboxylic acids (glucoheptonate) result in increased drainage rates of when used with a caustic blend on press felt swatches loaded with either a low concentration of papermaking fines or a high concentration of papermaking fines. As can be seen in FIG. 4 and FIG. 5, maleic anhydride and glucoheptonate resulted in increased drainage rates of solutions passed though ¾" press felt swatches using the Drainage Wash Study Method. These specific examples used a 15" Hg vacuum, a 120° F. wash temperature, and tap water. The data of FIG. 4 depicts the drainage rate slope change (%) of product wash solutions passed through ¾" press felt swatches that were pre-loaded with either low papermaking fines (0.71%) or high papermaking fine (3.96%). Additionally, the data from FIG. 4 demonstrates that at certain concentrations, the addition of surfactants to the mixture of anionic polymeric dispersants and hydroxyfunctional carboxylic acids can further increase the drainage rate of wash product solutions. The data of FIG. 5 depicts the drainage rate slope change (%) of triple tap water rinses after passing wash solutions through ¾" press felt swatches that were pre-loaded with either low papermaking fines (0.71%) or high papermaking fine (3.96%). Additionally, the data from FIG. 5 demonstrates that at certain concentrations, the addition of surfactants to the mixture of anionic polymeric dispersants and hydroxyfunctional carboxylic acids can further increase the drainage rate of triple tap water rinses after passing wash solutions through ¾" press felt swatches that were pre-loaded with either low papermaking fines (0.71%) or high papermaking fine (3.96%).

Having described the invention in detail and by reference to preferred embodiments thereof, it will be apparent that modifications and variations are possible without departing from the scope of the claimed subject matter. Thus, it is intended that the specification cover the modifications and variations of the various embodiments described herein provided such modifications and variations come within the scope of the appended claims and their equivalents.

What is claimed is:

1. A method of treating and cleaning papermaking fabrics including one or more papermaking felts to increase a drainage rate, the method comprising:

applying an alkali material in combination with an anionic polymeric dispersant and a hydroxyfunctional carboxylic acid to the one or more papermaking felts of the papermaking fabrics as a single aqueous solution to increase a drainage rate through the papermaking fabrics, wherein the papermaking fabrics are contaminated with contaminants comprising wet soils that are hydrophilic and include papermaking fines, and wherein the single aqueous solution comprises a pH from about 9.5 to about 13.5 and a dynamic surface tension of about 25 mN/m to about 40 mN/m; and based on the application of the single aqueous solution of the alkali material in combination with the anionic polymeric dispersant and the hydroxyfunctional carboxylic acid, removing the contaminants from the papermaking fabrics and improving the drainage of the one or more papermaking felts of the papermaking fabrics such that a resulting drainage rate from the single aqueous solution is higher than the drainage rate through application of the alkali material alone to the one or more papermaking felts of the papermaking fabrics.

2. The method of claim 1, wherein the papermaking fabrics are contaminated with wet soils in an amount from about 0.1 to about 100% by weight.

3. The method of claim 1, wherein the alkali material is selected from the group consisting of sodium hydroxide, potassium hydroxide, magnesium hydroxide, ammonia, sodium carbonate, sodium silicate, sodium phosphates, potassium phosphates, alcohol amines, and combinations thereof.

4. The method of claim 1, wherein the anionic polymeric dispersant is selected from the group consisting of polyacrylic acid and sulfonated analogs and salts thereof, polymaleic acid and sulfonated analogs and salts thereof, poly (maleic anhydride) and sulfonated analogs and salts thereof, polyphosphinocarboxylic acid and sulfonated analogs and salts thereof, polyglutamic acid and sulfonated analogs and salts thereof, polyfumaric acid and sulfonated analogs and salts thereof, polylactic acid and sulfonated analogs and salts thereof, carboxylated vinyl polymers and sulfonated analogs and salts thereof, copolymers of acrylic acid and maleic acid and sulfonated analogs and salts thereof, and combinations thereof.

5. Method of claim 1, wherein the aqueous solution comprises from about 1% to about 20% by weight anionic polymeric dispersant.

6. The method of claim 1, wherein the hydroxyfunctional carboxylic acid is an alpha hydroxyl acid.

7. The method of claim 5, wherein the alpha hydroxyl acid is selected from the group consisting of lactic acid, gluconic acid, glycolic acid, citric acid, mandelic acid, and potassium or sodium salts thereof.

8. The method of claim 1, wherein the aqueous solution comprises from about 1% to about 20% by weight hydroxyfunctional carboxylic acid.

9. The method of claim 1, further comprising applying a surfactant.

10. The method of claim 9, wherein the surfactant is selected from the group consisting of nonionic surfactants, anionic surfactants, cationic surfactants, zwitterionic surfactants, and combinations thereof.

11. The method of claim 9, wherein the surfactant is selected from the group consisting of dodecylbenzene sulfonate, sodium-1-octane sulfonate, sodium caprylyl sulfonate, alcohol ethoxylates, and combinations thereof.

12. The method of claim 1, the aqueous solution further comprising a surfactant.

13. The method of claim 12, wherein the aqueous solution comprises from about 1% to about 20% by weight surfactant.

14. The method of claim 12, wherein the aqueous solution comprises from about 6% to about 18% by weight surfactant.

15. The method of claim 1, wherein the method further comprises applying one or more compounds selected from the group consisting of sodium hypocholorite, peroxides, triethanolamine, ethylenediaminetetraacetic acid, nitrilotriacetic acid, sodium silicate, tetrasdoium pyrophosphate, sodium tripolyphosphate, 1-(2,5-dimethoxy-4-methylphenyl)propan-2-amine, and combinations thereof.

16. The method of claim 1, wherein the aqueous solution further comprises one or more compounds selected from the group consisting of sodium hypocholorite, peroxides, triethanolamine, ethylenediaminetetraacetic acid, nitrilotriacetic acid, sodium silicate, tetrasdoium pyrophosphate, sodium tripolyphosphate, 1-(2,5-dimethoxy-4-methylphenyl)propan-2-amine, and combinations thereof.

17. The method of claim 1, wherein contaminants comprise organic contaminants.

18. The method of claim 1, wherein the papermaking fabrics comprise forming fabrics, press felt fabrics, and dryer fabrics.

19. The method of claim 1, wherein the aqueous solution is applied to the papermaking fabrics at a dosage of about 100 ppm to about 50,000 ppm while a papermaking machine is operating.

20. The method of claim 1, wherein the aqueous solution is applied to the papermaking fabrics at a dosage of about 0.1% to about 100% while a papermaking machine is not operating.

21. The method of claim 1, wherein the aqueous solution is applied to the papermaking fabrics through high pressure needle showers, fan showers, flooded nip showers, manual foaming equipment, or manual spraying equipment.

22. The method of claim 18, wherein the aqueous solution is applied to the papermaking fabrics continuously or intermittently.

23. The method of claim 1, wherein the aqueous solution is applied to the papermaking fabrics at a temperature from about 50° C. to about 60° C.

24. The method of claim 2, wherein the wet soils comprise of papermaking fibers and fines, hydrosols, hydrogels, or combinations thereof.

25. The method of claim 17, wherein the organic contaminants comprise of wet soils.

* * * * *